United States Patent [19]

Sone

[11] 4,447,054

[45] May 8, 1984

[54] SHEET PEELING PAWL

[75] Inventor: Yasuo Sone, Ebina, Japan

[73] Assignee: Fuji Xerox Co., Ltd.,, Tokyo, Japan

[21] Appl. No.: 339,936

[22] Filed: Jan. 18, 1982

[30] Foreign Application Priority Data

Jan. 23, 1981 [JP] Japan ..... 56-8160

[51] Int. Cl.[3] ..... B65H 29/54

[52] U.S. Cl. ..... 271/311; 271/DIG. 2

[58] Field of Search ..... 271/DIG. 2, 308, 311; 432/60; 118/60, 245

[56] References Cited

U.S. PATENT DOCUMENTS

| | | | |
|---|---|---|---|
| 3,885,786 | 5/1975 | Schmalzbauer | 271/DIG. 2 X |
| 3,955,916 | 5/1976 | Bar-on | 271/DIG. 2 X |
| 4,065,120 | 12/1977 | Imaizumi | 271/DIG. 2 X |
| 4,156,524 | 5/1979 | Bar-on | 271/DIG. 2 X |

*Primary Examiner*—Richard A. Schacher

*Attorney, Agent, or Firm*—Sughrue, Mion, Zinn, Macpeak and Seas

[57] ABSTRACT

A peeling pawl is stamped from a metal sheet of preferably less than 100 μm in thickness with a Young's modulus of substantially between $10\times10^3$ and $30\times10^3$ kg/mm$^2$.

6 Claims, 9 Drawing Figures

SHEET PEELING PAWL

BACKGROUND OF THE INVENTION

This invention relates to a sheet peeling pawl the top end portion of which is abutted against the surface of a photo-sensitive material or the surface of a fixing roll in an electronic copying machine to peel a sheet off the surface thereof.

In general, a conventional sheet peeling pawl of this type is in the form of a wedge, or some other special configuration, and the conventional sheet peeling pawl must be manufactured with high machining accuracy. Therefore, the manufacturing cost is high, and a high positioning accuracy is required when it is mounted on the copying machine. Furthermore, a conventional sheet peeling device including such a sheet peeling pawl has a number of components which must be adjusted and uses springs and other parts in order to abut against the photo-sensitive material surface or the fixing roll surface under a predetermined pressure. Thus, the conventional sheet peeling device is intricate in construction, and the cost for assembling the device and the cost for mounting it on the machine are considerably high.

One type of peeling pawl is made of a sheet-shaped material of synthetic resin such as polyester or polyethylene which is excellent in wear resistance and is also flexible. The sheet peeling pawl in the form of a sheet, which is bent to abut against the photo-sensitive material or the fixing roll, is obtained by punching from the sheet-shaped material. Therefore, such a peeling pawl can be readily manufactured. Since the peeling pawl can easily bend to abut against the photo-sensitive material surface or the fixing roll surface, it can be brought into contact with the photo-sensitive material or the fixing roll without the need for either high machining accuracy or high mounting accuracy. The peeling pawl can be mounted in the copying machine by securing it to a supporting member near the fixing roll with a two-sided adhesive tape or screws. Thus, this peeling pawl is advantageous in that it can be readily mounted in and removed from the copying machine, and it is considerably simple in construction.

However, the conventional sheet-shaped peeling pawl is disadvantageous in that it is made of a sheet of synthetic resin such as polyester or polyethylene as described above. Therefore, while sheets onto which images have been transferred (hereinafter referred to as "image-transferred sheets") are repeatedly peeled off with the peeling pawl, the top end portion of the peeling pawl quickly deteriorates, as a result of which the peeling pawl then fails to peel off image-transferred sheets. If the thickness of the peeling pawl is increased in order to prevent the deterioration of the top end portion, then it is impossible to positively peel off sheets; that is, the peeling pawl cannot function as required.

SUMMARY OF THE INVENTION

In view of the foregoing, the present invention comprises a sheet peeling pawl which is made of a sheet-shaped material and which is bent to peel off a sheet which is conveyed on a photo-sensitive material surface or a fixing roll surface, which is made of a metal material having a longitudinal elastic coefficient (Young's modulus) of $10\times10^3$ to $30\times10^3$ kg/mm$^2$, whereby even when the thickness of the pawl is reduced to the extent that the pawl can positively peel off a sheet, i.e., 100$\mu$ or less, the top end portion thereof does not significantly deteriorate during extended operation. The peeling pawl can be bent to abut against the photo-sensitive material surface or the fixing roll surface, and with the top end portion brought into surface contact with the photo-sensitive material or fixing roll surface, the photo-sensitive material or the fixing roll will not be damaged thereby if the peeling pawl is bent under a pressure of several grams to contact the surface of the photo-sensitive material or fixing roll.

BRIEF DESCRIPTION OF THE DRAWINGS

Preferred embodiments of this invention will be described with reference to the accompanying drawings, in which.

DETAILED DESCRIPTION OF THE INVENTION

Figure 1:
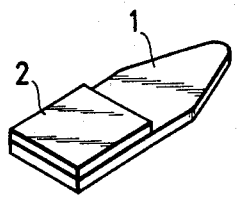
FIG. 1 is a perspective view showing one example of the peeling pawl according to this invention.
Figure 2:
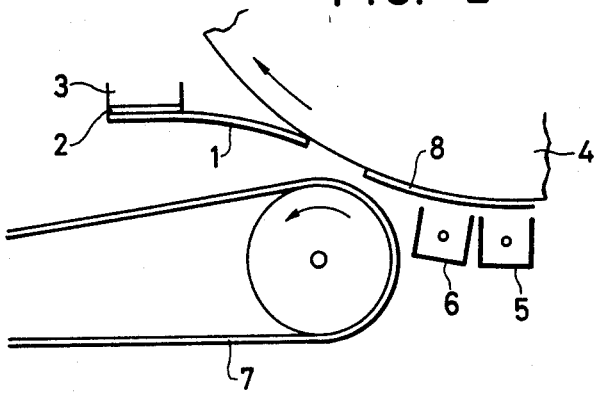
FIGS. 2 and 3 are diagrams showing how to use the peeling pawl.
Figure 3:
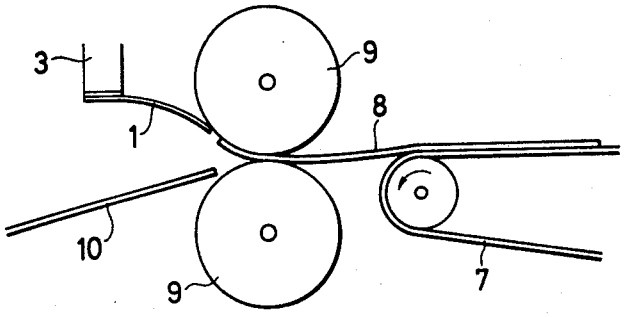

FIG. 1 shows one example of a sheet peeling pawl according to the present invention. The sheet peeling pawl 1 is in the form of a sheet. One surface of a two-sided adhesive tape 2 is bonded to the base of the sheet peeling pawl 1, and the other surface is bonded to a sheet peeling pawl supporting member 3 which is positioned so that the top end portion of the sheet peeling pawl is abutted against the surfaces of a photo-sensitive material 4 as shown in FIG. 2 or the surface of a fixing roll 9 as shown in FIG. 3 and the peeling pawl 1 is bent as desired. In FIGS. 2 and 3, reference numeral 5 designates a transferring charger; 5, a discharger; 7, a sheet conveying member; 8, a sheet; and 10, a sheet guiding plate.

The peeling pawl 1 according to the invention is manufactured by punhuing or etching a metal sheet having a Young's modulus of $10\times10^3$ to $30\times10$ kg/mm$^2$, and it is secured to a supporting member near the photo-sensitive material or the fixing roll with a two-sided adhesive tape or screws. Therefore, it can be readily installed or removed.

The thickness of the peeling pawl should be 100$\mu$ or less in order to positively peel off a sheet, and the peeling pawl must be abutted against the photo-sensitive material surface or the fixing roll surface under a pressure of no more than several grams in order to protect the surface from damage. If the peeling pawl is to be bent under a pressure of several grams to contact the photo-sensitive material surface or the fixing roll surface, the proper thickness of the peeling pawl can be determined from a peeling characteristic required. Once the proper thickness is selected, the Young's modulus of the material for the peeling pawl will also then necessarily be determined. Thus, the aforementioned Young's modulus of $10\times10^3$ to $30\times10^3$ kg/mm$^2$ has been determined.

Figure 4A:
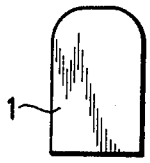
FIGS. 4(*a*) and 4(*b*) show other examples of the sheet peeling pawl according to the invention.
Figure 4B:
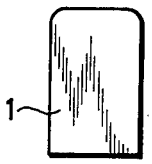
Figure 5A:
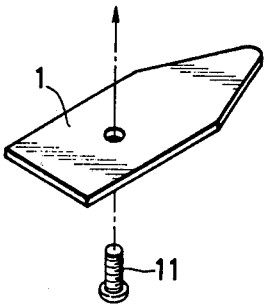
FIGS. 5(*a*) and 5(*b*) show alternative pawl mounting configurations.
Figure 5B:
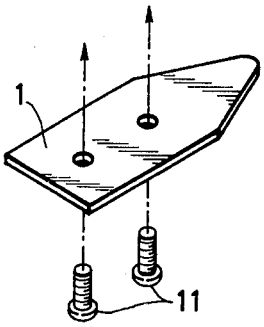

The configuration of the sheet peeling pawl is not particularly limited. The sheet peeling pawl may be shaped as shown in FIGS. 4(*a*) or 4(*b*) depending on factors such as sheet peeling efficiency, pawl machining efficiency or a pawl handling effect. Furthermore, it is not always necessary to use the two-sided adhesive tape to secure the sheet peeling pawl to the supporting member 3, but the sheet peeling pawl may instead be secured to the supporting member 3 with a screw or screws as shown in FIGS. 5(*a*) and 5(*b*).

Figure 6A:
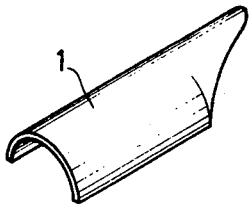
FIGS. 6(*a*) and 6(*b*) illustrate further variations of the invention.
Figure 6B:
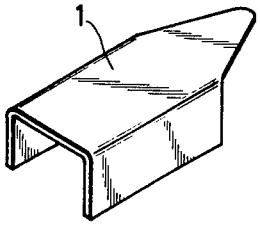

The use of the sheet peeling pawl of the invention is not limited only to the case where the peeling pawl is maintained in contact with the surface of the photo-sensitive material or fixing roll at all times, but the peeling sheet may also be used in such a manner that it is intermittently brought into contact with the surface in synchronization with the conveyance of an image transferred sheet. Further, the sheet peeling pawl may be formed in an arcuate or U-shaped section as shown in FIGS. 6(*a*) and 6(*b*).

The conventional sheet-shaped peeling pawl is made from a sheet of synthetic resin such as polyester or polyethylene as described before. More specifically, it is manufactured by punching the synthetic resin sheet. Since the material is soft, burrs are liable to be formed at the top end portion of the peeling pawl. Therefore, if the side of the top end portion, where the burrs are formed, is set to contact the photo-sensitive material, then the latter is scratched, and if it is set on the side of the image-transferred sheet passage, then the burrs will catch an image-transferred sheet, and the peeling pawl may fail to operate properly.

On the other hand, in the case where the peeling pawl is made of a metal material according to the present invention, the material is hard, and therefore even when the peeling pawl if manufactured by punching the hard material, burrs are scarcely formed if the die clearance is made sufficiently small. Furthermore, the peeling pawl can be manufactured by an etching method which will form no burrs. Thus, the peeling pawl manufactured according to the present invention will never damage the photo-sensitive material and will never fail to peel off a sheet. Since the metal material is used, deterioration of mechanical characteristics of the peeling pawl or of the top end portion of the pawl is much less likely to be caused by heat generated in the fixing roll. Therefore, the sheet-shaped peeling pawl of metal can be employed as a sheet peeling pawl for the fixing roll, although the conventional peeling pawl of synthetic resin cannot satisfactorily be applied to the fixing roll.

As is apparent from the above description, according to this invention, the sheet peeling pawl 1 is abutted against the surface of the photo-sensitive material 4 or the fixing roll 9 with a suitable bend. Therefore, it is unnecessary to obtain high machining accuracy and mounting accuracy which are required with the conventional peeling pawl to allow the peeling pawl of the invention to abut against the surface of the photo-sensitive material or fixing roll under substantially constant pressure. As the peeling pawl is bent and brought into contact with the surface of the photo-sensitive material or fixing roll, the top end portion of the peeling pawl is in surface contact with the surface of the photo-sensitive material or fixing roll. Accordingly, if the top end portion of the peeling pawl is brought into contact with the surface under a pressure of no more than several grams, the surface of the photo-sensitive material or fixing roll will never be damaged thereby. If the peeling pawl is made of metal, then the thickness of the peeling pawl can be made smaller than that of the conventional sheet peeling pawl which is made of synthetic resin. Therefore, the sheet peeling pawl of the invention can positively peel off a sheet onto which an image has been transferred and deliver it to the following process stage or to a discharge outlet.

What is claimed is:

1. In an image recording machine of the type wherein a sheet is conveyed along a surface, a sheet peeling pawl for engaging said sheet and peeling said sheet away from said surface, the improvement characterized in that said pawl is comprised of a metal material having a Young's modulus of substantially between $10/10^3$ and $30\times10^3$ kg/mm$^2$, said pawl including a mounting portion and a forward portion which is contiguous at one end with said mounting portion and has a front end portion for engaging said sheet at the other end, said mounting portion and forward portion being arcuately formed and said forward portion tapering toward said front end portion.

2. A pawl as claimed in claim 1, wherein said pawl is a sheet portion of said metal material having a thickness of no more than approximately 100 $\mu$m.

3. A pawl as claimed in claim 1, wherein said pawl includes a front end portion for contacting said surface under a bending force applied to said pawl.

4. In an image recording machine of the type wherein a sheet is conveyed along a surface, a sheet peeling pawl for engaging said sheet and peeling said sheet away from said surface, the improvement characterized in that said pawl is comprised of a metal material having a Young's modulus of substantially between $10\times10^3$ and $30\times10^3$ kg/mm$^2$, said pawl including a mounting portion and a forward portion which is contiguous at one end with said mounting portion and has a front end portion for engaging said sheet at the other end, said mounting portion being substantially a rectangular U-shape and said forward portion being contiguous and coplanar with a center part of said U-shape.

5. A pawl as claimed in claim 4, wherein said pawl is a sheet portion of said metal material having a thickness of no more than approximately 100 $\mu$m.

6. A pawl as claimed in claim 4, wherein said pawl includes a front end portion for contacting said surface under a bending force applied to said pawl.

* * * * *